United States Patent [19]

Antonius

[11] 4,372,560

[45] Feb. 8, 1983

[54] THERAPEUTIC GAME

[76] Inventor: John I. Antonius, 3848 SW. 36th Pl., Portland, Oreg. 97221

[21] Appl. No.: 283,952

[22] Filed: Jul. 16, 1981

[51] Int. Cl.[3] ..... A63B 71/00; A63F 9/02

[52] U.S. Cl. ..... 273/408; 128/1 R; 273/317

[58] Field of Search ..... 273/403, 404, 408, 317, 273/348; 128/1 R

[56] References Cited

U.S. PATENT DOCUMENTS 580,207 4/1897 Boemermann et al. ..... 273/63 E 3,762,708 10/1973 Hing ..... 273/402 X

OTHER PUBLICATIONS

Aids & Appliances Catalog, Jul. 1972–Jun. 1973, p. 5.

*Primary Examiner*—Anton O. Oechsle

*Attorney, Agent, or Firm*—Kolisch, Hartwell & Dickinson

[57] ABSTRACT

A game including a barrier which positions the player with the player facing the barrier. The player, with a missile carried in one hand, strikes the barrier and then throws the missile toward a target located on the opposite side of the body from the side where such hand is located.

5 Claims, 3 Drawing Figures

THERAPEUTIC GAME

BACKGROUND AND SUMMARY

This invention relates to a game wherein a player or participant, on his own command, goes through various motions culminating in the player throwing a missile at a target. A related object is the provision of a treatment process which coordinates physical activity with mental stimulus. Playing of the game is entertaining, with the skill level of a player increasing over a period of time as hand and eye dexterity improves.

The game may be played by a single player, or amongst a number of players, with scoring accuracy compared amongst the various contestants.

The sequence of play is initiated by the participant using one of his hands and moving the arm carrying such hand to produce a sound, which preferably is produced by the participant striking an implement carried in his hand against a resounding bar. The player then, in a smooth and coordinated manner, raises his hand, and with turning of his head to the side of the body opposite the side on which the hand is located, and with throwing of the implement across the front of his body, projects the implement against an outwardly located target. With the implement taking the form of a missile, such will stick in the target on its reaching the target. Since throwing the missile and observing of the target takes place substantially simultaneously, quickness in determining target location and coordination in the throwing arm in the proper direction to strike the target is required. The right hand and arm may be utilized in the throwing of a missile against a target located to the left side of the participant, and the left hand and arm may be utilized in the throwing of a missile against a target located to the right side of a participant. In this way, quickness and dexterity in both sides of the body may be encouraged.

The invention, as well as various objects and beneficial results attained by the invention, will become more fully apparent from a reading of the following description, which is to be taken in conjunction with the accompanying drawings, wherein.

A DETAILED DESCRIPTION OF A PREFERRED EMBODIMENT OF A INVENTION

Figures 1, 2, 3:
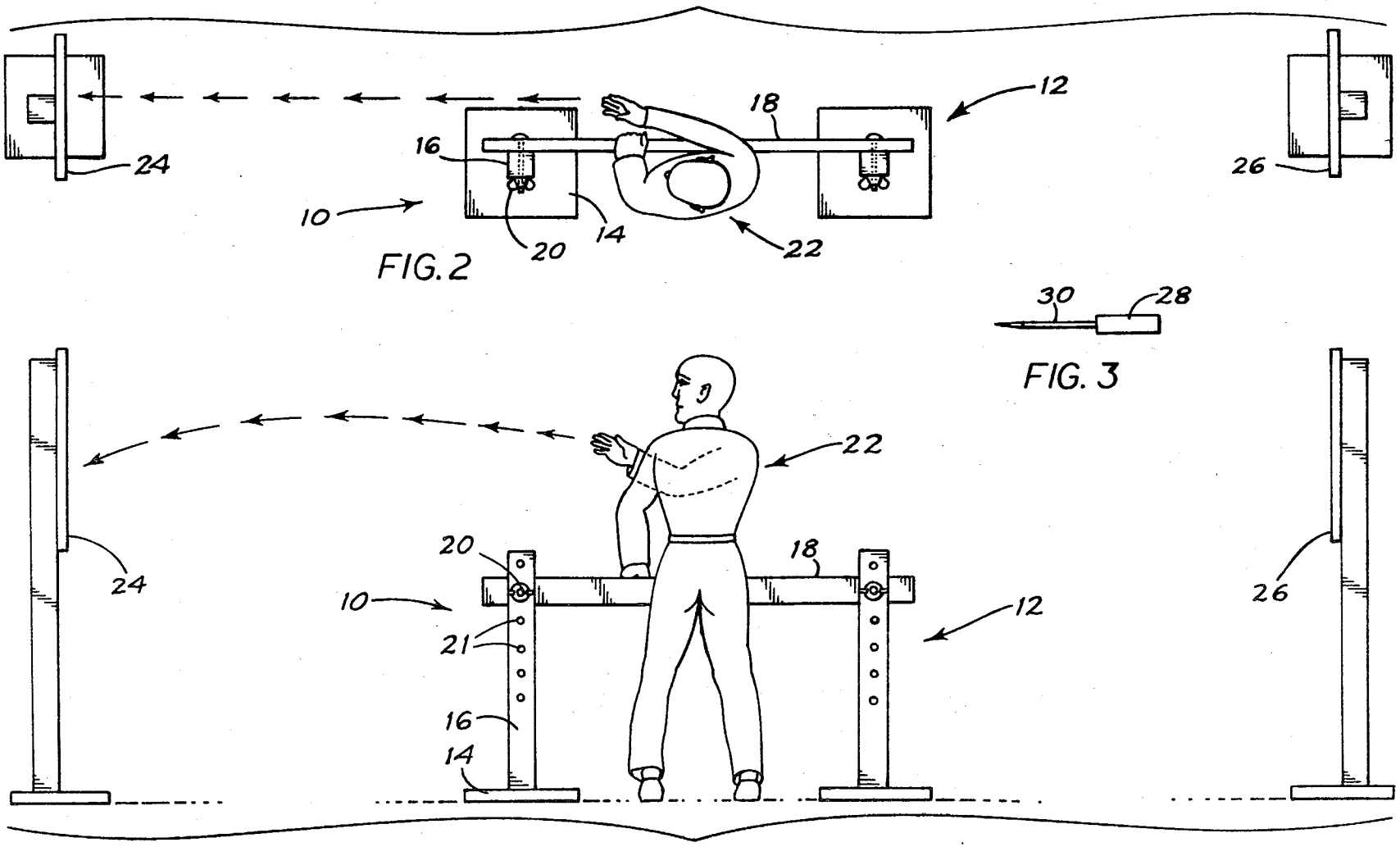
FIG. 1 is a top plan view, showing a playing area and a participant of the game in the act of throwing a missile at a laterally located target area.
FIG. 2 is an elevation view, illustrating the participant in the act of throwing the missile.
FIG. 3 is an illustration of a form of missile that may be used.

Generally describing the invention, and the specific embodiment illustrated in the drawings, illustrated at 10 and 12 are a pair of supports. These are portable, and each comprises a base 14 adapted to rest in a firm manner on the ground, and secured to this base an upright 16.

Spanning the uprights of the supports and mounted on the supports is a beam 18. Preferably such has a metallic construction, so that on being struck, a sharp metallic ring results.

Beam 18 preferably is detachably supported on uprights 16, since this enables the assembly to be broken down for storage purposes. More importantly, during playing of the game, the beam is struck with an implement held in one hand by the participant and thus, the beam should have a height which is at least about knee level and preferably about the level of the waist of the participant involved. With different age groups playing the game, adjustability in height in the beam is desirable.

Thus, the beam is shown attached to the uprights utilizing fastener assemblies including wing nuts 20 securing end portions of the beam to the uprights. A series of bores 21 provided along the length of each upright permit positioning of the beam at different elevations.

A participant in playing the game aligns himself with his body facing the beam and usually touching the beam. The beam thus forms a barrier, and with supports 10, 12 define a playing station for the participant located between the uprights 16.

Disposed to one side of a participant occupying the playing station, such participant being indicated at 22, is a target 24. Such is normally elevated and stationary, although in variations of the game a moving base may be provided for the target whereby it comprises a moving target. The target may be substantially aligned with the beam so as to be directly to one side of a participant in the playing station, but ordinarily such may be placed slightly in advance of the beam while being laterally located, for ease of play, particularly with newcomers to the game. Similarly, mounted on the opposite side of the playing station in an elevated position is another target 26.

In playing the game, the participant throws a missile or implement at the target. The missile may take the form shown in FIG. 3, where such comprises a handle 28 and a pointed end extending outwardly from the handle, as shown at 30. Preferably, the pointed end is of metallic construction, so that on such being struck against the beam which is also metallic, a sharp ringing sound results.

Describing generally how the game may be played, a participant takes his position in the playing station, with his body facing forwardly and positioned by the beam, and the participant being located between the supports. Targets are positioned to the left and right side of the barrier formed by the beam, normally in an elevated position as earlier described.

Assuming initial use of the right hand and arm, the participant grasps the missile by the handle, and on commencing a sequence of play, drops his arm to bring the metallic end of the missile into sharp contact with the beam. This produces a sharp sound primarily registering with the right ear of the participant.

The participant then, with continuing smooth movement, raises the missile along the side of his body, and at that time turns his head to view the target located outwardly beyond his left side. In as smooth and coordinated fashion as possible, the participant then throws the missle across the front of his body and toward the target. With the target being viewed at about the same time that throwing motion is initiated, hand and eye coordination are stimulated.

The same sequence of play can be performed using the left hand, and after striking of the missile against the bar, propelling the missile by movement of the left hand across the front of the body to project the missile against the target located toward the participant's right.

Left and right arms can be used alternately, or a series of right hand throws can be interspersed with a series of left hand throws. In a competitive game, various participants take turns with performance gauged, for instance, on accuracy and, when refinements are required, in the time that elapses from the time that the striking of the bar produces a noise and the time that the target is observed to be struck by the missile.

Playing the game has therapeutic value as observed from viewing the performances of various participants. The left cerebral hemisphere, in general, controls muscular reactions on the right side of the body and is sensitive to sound detected by the ear on the right hand side of the body. Conversely, muscular action in the left side of the body and noise detected primarily by the left ear involves electric current responses primarily centered in the right cerebral hemisphere of the brain. Furthermore, peripheral vision in the left region of one's left eye and in the left region of one's right eye, primarily produces responses in one's left cerebral hemisphere whereas peripheral vision in the right region of one's right eye and the right region of one's left eye primarily produces responses in the right cerebral hemisphere. Accordingly, when viewing to the left when playing the game, brain activity resulting from viewing the target with peripheral vision is primarily in the left cerebral hemisphere, the same hemisphere which is controlling muscles used in throwing the implement to the left and which is receiving an electric current in brain relay centers as results from the right ear hearing the striking noise produced by striking of the missile against the beam.

From this discussion it can be seen that playing the game produces a coordinated response between brain activity and muscular activity primarily utilizing the left cerebral hemisphere when throwing from right to left, and the right cerebral hemisphere when throwing from left to right.

It is claimed and desired to secure by Letters Patent:

1. A game comprising:

an elongate barrier and spaced means supporting opposite extremities of the barrier in an elevated position which is at or above knee level of a participant in the game, such barrier establishing a forward facing position in a player's station located between the means supporting the ends of the barrier, a target mounted in an elevated position beyond one end of said barrier thus to be spaced laterally to one side of a participant having said forward facing position in said player's station, another target mounted in an elevated position beyond the other end of the barrier thus to be spaced laterally to the other side of a participant having said forward facing position in said player's station, and a hand-graspable missile adapted to be thrown by a participant having said forward facing position in said player's station alternatively toward said one target and said other target.

2. The game of claim 1, wherein said barrier and said missile are a combination of materials producing a sharp sound when the missile is struck against the barrier.

3. A treatment method for exercising a participant's body muscles in coordination with brain activity generated in left or right hand cerebral hemispheres which comprises:

the participant while standing, positioning his body with such facing in a given direction, the participant, with the hand located on one side of the body and while grasping an implement, moving the implement to effect a sound primarily heard by the ear on the same side of the body as the side where his hand is located, and the participant with his said one hand, and with turning of his head to the side of the body opposite to said one side of the body, throwing the implement across the front of his body toward a target located outwardly beyond his said opposite body side.

4. The treatment method of claim 3, wherein the participant moves the implement downwardly along his said one side of the body against a sounding instrumentality to produce the sound, and then lifts his hand preparatory to throwing the implement across the front of his body toward the target.

5. The treatment method of claim 4, wherein after throwing of the implement toward the target, the participant, with his hand located on the opposite side of his body, grasps an implement and moves the implement to effect a sound primarily heard by the ear on the opposite side of his body, and the participant then with his hand on said opposite side of the body turns his head to his said one side of the body and with his hand on the opposite side of the body throws the implement across the front of his body toward another target located outwardly beyond his said one body side.

* * * * *